US006141802A

United States Patent [19]

Drake

[11] Patent Number: 6,141,802

[45] Date of Patent: Nov. 7, 2000

[54] PANTS INCORPORATING A TICK BARRIER SYSTEM

[76] Inventor: Joseph T. Drake, 1027 W. Placita Camillia, Tucson, Ariz. 85704

[21] Appl. No.: 09/042,330

[22] Filed: Mar. 13, 1998

[51] Int. Cl.[7] ..... A41D 1/06; A41D 1/08

[52] U.S. Cl. ..... 2/227; 2/22; 2/23

[58] Field of Search ..... 2/227, 22, 242, 2/239, 23, 59, 61, 231, 232; 43/114, 121, 107

[56] References Cited

U.S. PATENT DOCUMENTS

| | | | |
|---|---|---|---|
| 189,883 | 4/1877 | Thompson | 2/227 |
| 1,143,282 | 6/1915 | King | 2/227 |
| 1,652,750 | 12/1927 | Wohlgemuth | 2/227 |
| 2,216,852 | 10/1940 | McMeekin | 2/227 |
| 2,261,360 | 11/1941 | Gerendas | 43/108 |
| 4,881,671 | 11/1989 | Horton et al. | 43/131 |
| 5,003,635 | 4/1991 | Peterson | 2/69 |
| 5,005,215 | 4/1991 | McIlquham | 2/22 |
| 5,155,950 | 10/1992 | Burgeson | 2/311 |
| 5,249,310 | 10/1993 | Forte | 2/242 |
| 5,381,557 | 1/1995 | Luria et al. | 2/242 |

*Primary Examiner*—Amy B. Vanatta

[57] ABSTRACT

A tick barrier system for a pair of pants. The system makes use of a tick shield located within a bottom section of each pant leg of the pants. Each shield is tubular in shape and has only its top end secured to an inner surface of the pant leg. The bottom end of the tick shield is located within the pant leg near the bottom end of the associated pant leg. The shield has a white surface and is made of a flexible material, such as fabric or paper. In use, the shields are designed to be tucked into a user's socks and thereby prevent ticks from coming into direct contact with the skin of the user's legs.

2 Claims, 2 Drawing Sheets

PANTS INCORPORATING A TICK BARRIER SYSTEM

FIELD OF THE INVENTION

The invention is in the field of protective clothing. More particularly, the invention is a tick barrier system for a pair of pants. The system makes use of a pair of specially-designed shields, with one shield located inside each pant leg. The shields are adapted to allow the placement of a bottom portion of the shields within a top portion of a user's socks. The shields then function to prevent ticks from gaining access to the skin of the user's legs.

Each shield is made of a thin, flexible material and is tubular in shape. In the preferred embodiment, the shield is made of a breathable fabric. While the entire shield is located within the pant leg, only the top of the shield is secured to the pant leg's inner surface. The shield's top portion is secured such that it creates a complete seal between the pants and the shield. Both permanent and removable forms of the shield are disclosed. The shield is treated with an insect repellant to enhance its effectiveness.

BACKGROUND OF THE INVENTION

In recent years, a significant amount of research has been done relative to the transmission of diseases from infected ticks to humans. Ticks are known to carry potentially dangerous diseases such as Lyme disease, Lone Star Tick Syndrome and Rocky Mountain Tick Fever. It has been discovered that when a human is bitten by an infected tick, this can result in the disease being transmitted to the human, with possibly dire consequences. For the many people who enjoy outdoor activities and are thereby routinely exposed to ticks, significant effort has been made to educate these people about the hazards associated with tick bites and precautions that can be taken to minimize the potential for tick bites.

One of the easiest, and most well-known, methods to help prevent tick bites is to tuck the bottom end of each pant leg into one's socks. This prevents the ticks from achieving direct contact with the skin of one's legs. However, this is not a perfect solution, and there are some problems associated with following this advice.

Firstly, depending on the fabric and cut of the pants, tucking the pant legs into one's socks can damage the socks. When the bottom of the pant leg is gathered within the sock, the top of the sock must stretch to accommodate the extremely bulky mass of the contained portion of the pant leg. This problem is made worse when bulkier than normal pants, such as pants that feature a boot-cut leg or are made of a very thick or padded material, are involved. As a result, when a user stretches the top of the sock over the bottom of the pant leg, the bulkiness of the pants material may cause over-stretching of the sock's elastic top. Not only may this lead to premature failure of the sock's elastic, but the stretched elastic can apply significant pressure to the user's calf or ankle.

Secondly, tucking a pant leg into a sock can cause the material of the sock to be stretched to a point where openings are created in the sock's weave. Once openings are created in the weave, there is the potential for small ticks, such as deer ticks, to be able to crawl through an opening and onto the wearer's skin. This problem is greatly exacerbated when bulky pants, such as hunting pants, are worn.

Thirdly, there are instances when it is desirable for a person to have one's pants covering the top of one's footwear. For example, a hunter will often wear black, rubberized boots in conjunction with camouflage-colored pants. To maximize the camouflage of the hunter's clothing, it is desirable for the top of the boots to be located within the hunter's pants. This is not possible if the hunter tucks his or her pants into his or her socks. In addition, many people prefer the look of pants that are not tucked into one's socks.

SUMMARY OF THE INVENTION

The invention is a tick barrier system for pants. The system employs two identical, specially-designed shields. Each pant leg of the pants will include one of said shields. The chemically treated shields function to prevent ticks from gaining access to the skin of the user's legs.

Each shield is tubular in shape and is located completely within the pant leg. The top end of each shield is secured to the pant leg, either above or below the knee. The shield's top portion is secured such that it creates a complete seal between the pants and the shield. The remainder of the shield is unsecured to the pant leg and extends downwardly to end at, or preferably slightly above, the bottom end of the pant leg. This enables a user to tuck the bottom portion of each shield into his or her socks and obtain the same barrier protection that was formally only obtainable through tucking both pant legs into his or her socks.

The shields are preferably made from a thin, flexible material. In the preferred embodiment, a breathable fabric, such as cotton cloth, is employed. While other materials can be employed, including non-breathable synthetics or even paper materials, a breathable material will enhance user comfort since the material will normally be in continual contact with the user's skin. By employing a thin material, the shield can be tucked into the user's sock without significantly stretching the elastic in the top portion of the sock. This avoids the premature failure, discomfort and the creation of openings in the sock's weave that could result from a pant leg being tucked into a sock.

The material used to form each shield is preferably light in color. A light color, such as white, is employed to enhance a user's ability to spot any ticks that might be on the surface of the shield. This is a significant improvement over the prior art whereby a tick could be on the surface of a dark pair of pants and be able to crawl onto the user's skin after the pants have been removed from within the sock.

Each shield preferably has a length of approximately four to eighteen inches. The location of the shield is such that the bottom of the shield will preferably be located approximately three inches above the bottom of the pant leg. In this manner, when the shield is tucked into a user's sock, the shield should not extend past the user's ankle. This avoids any discomfort that might result by the shield extending too far into the user's sock where it can be compressed between the shoe and the user's foot. The location of the shield should be noted in contrast to snowpants that include a tubular, fabric snow barrier that extends past the bottom of the pant leg and is designed to fit around the user's shoe or boot.

The securement of each shield to the associated pant leg may be of a permanent nature wherein said securement is in the form of sewn stitches or other conventional permanent-type securement methods. Alternatively, the top of each shield can be secured to the pant leg via a mechanism that enables easy removal of said shield. Forms of the latter type of securement include hook and fastener material such as VELCRO, adhesive materials, or other conventional releasable securement methods including zippers and other conventional types of interlocking structures.

As an additional precaution, the shields are treated with a tick-repelling chemical, such as DEET. The shield can either be pre-treated with such a chemical or the chemical can be applied by the user.

The use of the tick barrier system, as described, also enables a user to have his pant legs covering the top portion of his boots or shoes. In this manner, the user is able to wear his pants in the conventional-looking manner. For a hunter wearing camouflage pants, the pants can cover the upper portion of the hunter's boots in the normal fashion.

DETAILED DESCRIPTION OF THE DRAWINGS

Figure 1:
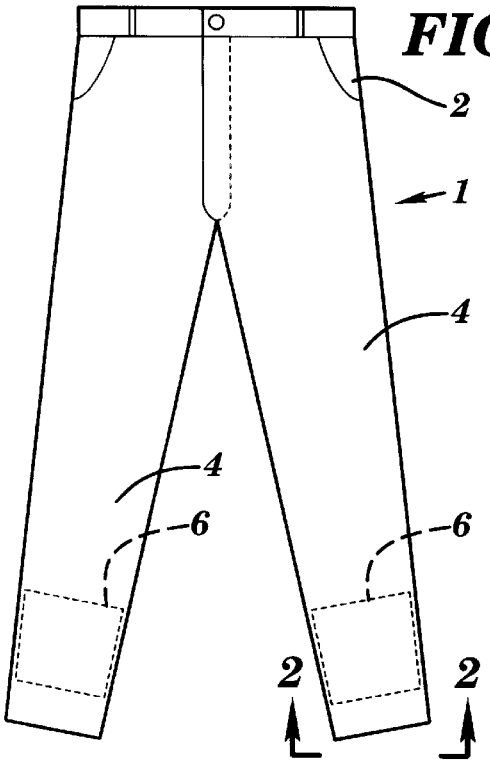
FIG. 1 is a front view of a pair of pants that incorporate a tick barrier system in accordance with the invention.

Referring now to the drawings in greater detail, wherein like characters refer to like parts throughout the several figures, there is shown by the numeral 1 a pair of pants that include a tick barrier system in accordance with the invention.

The pair of pants 1 are similar in outward appearance to any conventional pair of pants and includes a top portion 2 and two pant legs 4. The pants may be made of any conventional material, including relatively thick and/or padded material. Located within a bottom portion of each pant leg 4 is a tick shield 6.

Figure 2:
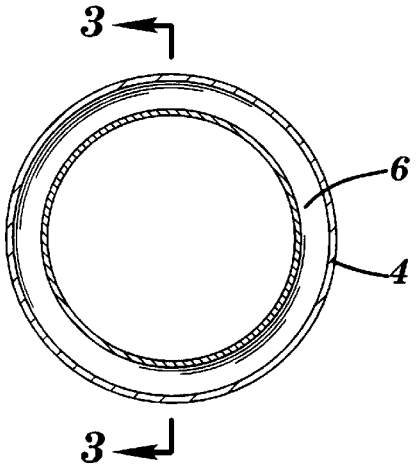
FIG. 2 is a bottom view of the bottom portion of the right pant leg shown in FIG. 1, and taken at the plane indicated by 2—2.
Figure 3:
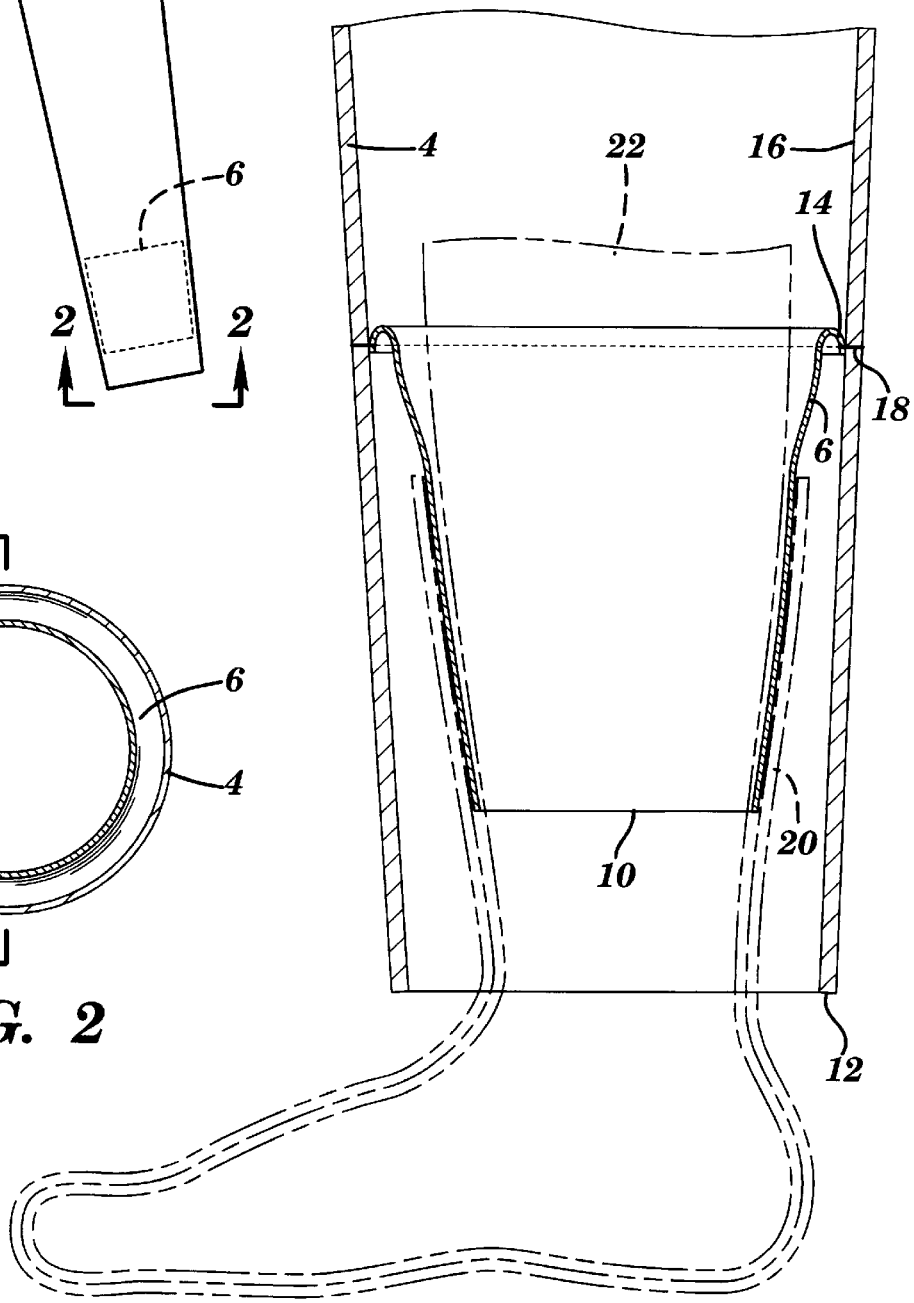
FIG. 3 is a cross-sectional, elevation view of the bottom portion of the right pant leg of the pants shown in FIG. 1, and taken at the plane indicated by 3—3 in FIG. 2. Also shown, in phantom, is the bottom portion of a wearer's leg and a sock.

In FIG. 1, the tick shields 6 are shown in phantom. FIGS. 2 and 3 provide views of one of the pant legs wherein one of the tick shields 6 can be viewed directly.

Each shield 6 is tubular in shape and is made of a thin, flexible material. In the preferred embodiment, a breathable material, such as cotton, is employed. Alternatively, other materials can be used, including synthetic fabrics such as rayon or nylon, and even non-fabric materials such as paper. The surface of the material used to form the shield is light in color, preferably white, to facilitate a user's ability to notice a tick located on the surface of the shield. The shield is chemically treated to provide maximum protection for the user.

In the preferred embodiment, the shield 6 is approximately 4—18 inches long and has an inner diameter of at least approximately four inches to enable it to fit around the ankle of a user. The length of the shield should be adequate to minimize the chances of the shield accidentally being disengaged from the sock. The bottom end 10 of the shield should be located no more than 4 inches above the bottom end 12 of the pant leg for the same reason. In the preferred embodiment, end 10 of the shield is located approximately three inches above end 12 of the pant leg. The bottom end 10 of the shield may be located less than three inches from the end 12 of the pant leg. However, the bottom end 10 should not extend past the bottom end 12 of the associated pant leg since that would cause a large mass of material to be bunched up within the sock and also cause user discomfort due to the shield being compressed between the user's shoe or boot and foot.

The shield's top end 14 is secured to the inner surface 16 of the pant leg. The securement location should be high enough in the pant leg where, for a user wearing boots, the securement location would be above the top of the boot. Securement of the shield to the pant leg is either of a permanent or removable nature. FIGS. 1–3 show a permanent securement whereby end 14 of the shield is sewn into the pants by stitches 18. The shield's top protion is secured such that it creates a complete seal between the pants and the shield.

In the preferred method of use, and as shown in FIG. 3, a user would tuck the shield 6 into his or her sock 20. As located, the shield would contact the user's leg 22. The shield, in conjunction with the sock, provides a barrier to ticks attempting to crawl onto the skin of the user's leg. Alternatively, for a user wearing two pairs of socks (not shown), the shield could be tucked between the inner and outer sock layers.

Figure 4:
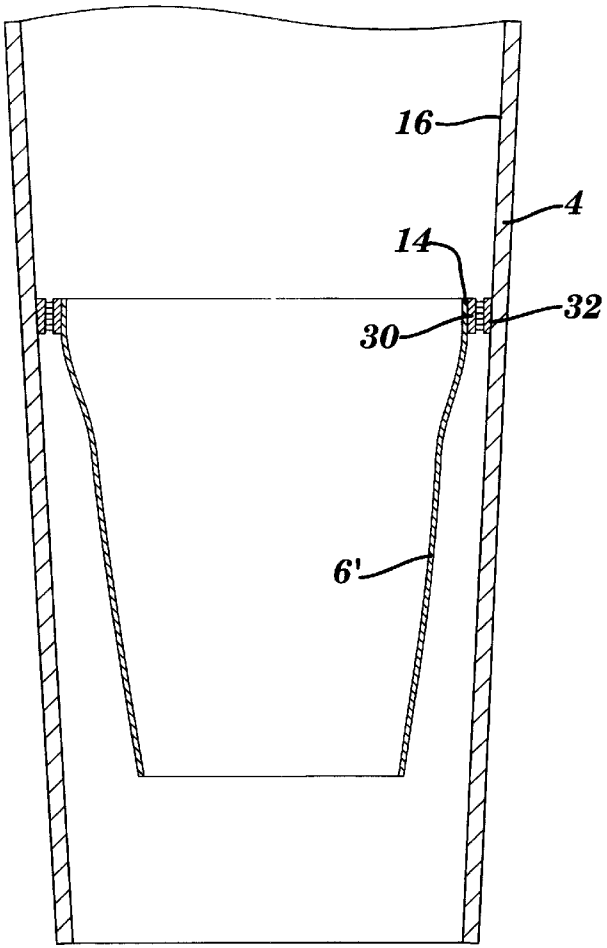
FIG. 4 is a cross-sectional, elevation view of the bottom portion of a pant leg, similar to FIG. 3, but incorporating a removable tick shield in accordance with the invention.

FIG. 4 shows another embodiment of a tick shield 6'. In this embodiment, the shield is basically identical to the shield 6 shown in FIGS. 1–3 except for the manner of securing the shield to the pant leg 4. As shown, the shield includes a pad 30 of either the hook or pile portion of a VELCRO-type hook and pile fastening system. The pad is preferably sewn to the top end 14 of the shield. The complementary hook or pile portion of the fastening system is located on a pad 32 that is secured to the inner surface 16 of the pant leg through a preferably permanent securement method such as sewn stitches or a permanent, waterproof adhesive. In this manner, the shield can be easily removed and re-installed into the pant leg by merely disengaging and then re-engaging the pads 30 and 32.

Figure 5:
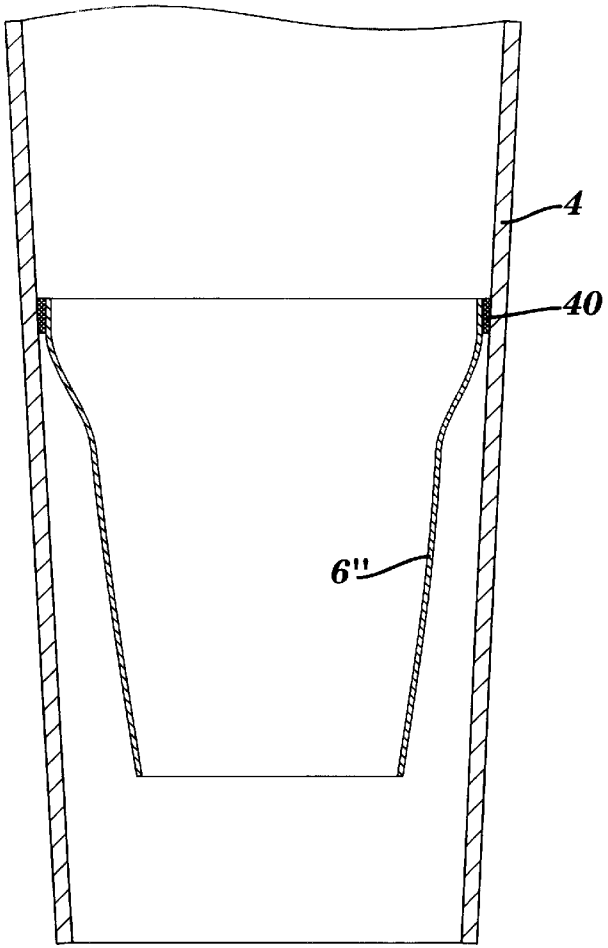
FIG. 5 is a cross-sectional, elevation view of the bottom portion of a pant leg, similar to FIG. 3, but incorporating a second version of a removable tick shield in accordance with the invention.

FIG. 5 shows another embodiment of a tick shield 6". In this embodiment, the shield is basically identical to the shield 6 shown in FIGS. 1–3 except for the manner of securing the shield to the pant leg. As shown, the shield includes an area 40 coated with an adhesive material. The adhesive can be of a type that causes either permanent securement, or of a type that is permanently tacky and can be engaged and disengaged from the pant leg material multiple times. The first type of adhesive enables a user to permanently secure the tick shield 6" to a conventional pair of pants. Once secured, the shield would remain in the pant leg for the life of the pants. The second type of adhesive also allows a user to attach a tick shield 6" to an existing pair of pants. However, the latter type of adhesive allows the user to remove the shield after a period of time. The advantage of the latter type of adhesive is that the shield could then be a disposable, single use insert and would not have to be sufficiently durable to withstand washing.

If the user wishes to further enhance the barrier system's ability to prevent ticks from contacting the user's legs, the shield 6, 6' or 6" can be sprayed with or be pre-treated with a tick repellant, such as DEET. An additional advantage to the removable shield is that removing the pad facilitates the treatment process and reduces the chance of spraying the tick-repelling chemical onto and staining the pants material. The use of a pre-treated shield would negate the need for the user to carry a spray can of said repellant. By adding a tick-repelling chemical to the shield, the shield would not only be a barrier to ticks, but would also repel ticks.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A pair of pants incorporating a tick barrier system, said pants comprising:

a top portion and two tubular pant legs that depend from said top portion;

a chemically treated tick shield located within each of said pant legs, wherein each tick shield is in the form of a light colored flexible tubular member and having a top end portion, a bottom end portion and an inner diameter, wherein only said top end portion of each tick shield is secured to create a complete seal on an inner surface of an associated one of said pant legs, wherein said bottom end portion of each tick shield is completely located within the associated pant leg, and wherein the inner diameter of each shield is capable of fitting around an outer diameter of the user's ankle; and wherein when a user who is wearing socks dons said pants, said user can place the bottom end portion of each of said tick shields within a top portion of an adjacent sock and then place an associated one of said pant legs in a position where it encircles and covers said top portion of said sock; and wherein said chemically treated tick shield comprises a tick repellent chemical.

2. The pants of claim 1 wherein each tick shield is made of a paper material.

* * * * *